US007625465B2

(12) United States Patent
Pesch et al.

(10) Patent No.: US 7,625,465 B2
(45) Date of Patent: Dec. 1, 2009

(54) VACUUM BELT CONVEYING DEVICE FOR GUIDING A MOVING WEB

(75) Inventors: Andreas Pesch, Krefeld (DE); Bernhard Schmitz, Willich (DE)

(73) Assignee: Andritz Kusters GmbH, Krefeld (DE)

( * ) Notice: Subject to any disclaimer, the term of this patent is extended or adjusted under 35 U.S.C. 154(b) by 416 days.

(21) Appl. No.: 11/564,224

(22) Filed: Nov. 28, 2006

(65) Prior Publication Data

US 2007/0119895 A1 May 31, 2007

(30) Foreign Application Priority Data

Nov. 30, 2005 (DE) ..... 10 2005 057 426

(51) Int. Cl.
*D21F 1/52* (2006.01)
*B65H 20/10* (2006.01)

(52) U.S. Cl. ..... 162/367; 162/193; 226/95; 271/197; 198/811

(58) Field of Classification Search ..... 162/193, 162/255, 306, 367; 226/93, 95, 97.3, 97.4; 271/96, 97, 196, 197; 198/811
See application file for complete search history.

(56) References Cited

U.S. PATENT DOCUMENTS 3,763,571 A * 10/1973 Vits ..... 34/641
3,889,801 A * 6/1975 Boyer ..... 198/689.1
4,542,842 A * 9/1985 Reba ..... 225/2
4,551,203 A * 11/1985 Eskelinen ..... 162/202
4,692,215 A * 9/1987 Kerttula ..... 162/289
5,893,505 A * 4/1999 Mueller ..... 226/97.3
6,290,817 B1 * 9/2001 Autio ..... 162/289
2005/0230447 A1 * 10/2005 Koljonen et al. ..... 226/95

FOREIGN PATENT DOCUMENTS

| | | | |
|---|---|---|---|
| DE | 3524006 | A1 | 2/1986 |
| DE | 20001082 | U1 | 4/2000 |
| DE | 10009188 | A1 | 8/2001 |
| DE | 29924658 | U1 | 8/2004 |
| EP | 1063168 | A2 | 12/2000 |
| EP | 1127978 | A2 | 8/2001 |

* cited by examiner

*Primary Examiner*—Eric Hug
(74) *Attorney, Agent, or Firm*—Townsend and Townsend and Crew LLP

(57) ABSTRACT

Vacuum belt conveying device for guiding a moving web, in particular a web threading strip of a paper or board web, having an air-permeable transport belt guided endlessly in a loop with an upper run and a lower run, and a device arranged within the loop for applying a vacuum to the inner side of one of the runs of the transport belt in order to hold the web firmly on the transport belt, in which the device for applying a vacuum is formed by means of at least one long-gap ejector, which in each case has an air jet injector having a large number of air outlet nozzles along the inlet side of the long gap and, on the inlet side, is positioned at a distance under the inner side of the run which is provided to hold the web firmly.

22 Claims, 6 Drawing Sheets

VACUUM BELT CONVEYING DEVICE FOR GUIDING A MOVING WEB

Figure 1:
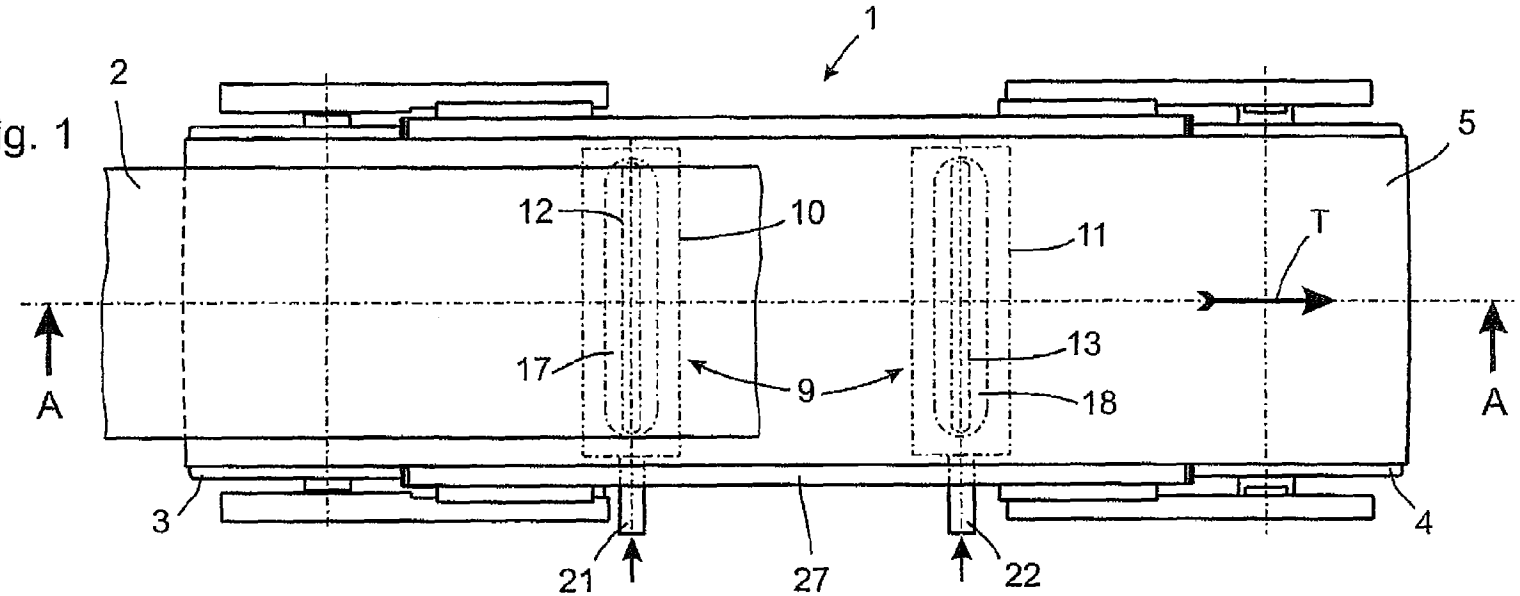

The invention relates to a vacuum belt conveying device for guiding a moving web, in particular a web threading strip of a paper or board web.

Vacuum belt conveying devices for guiding a moving web are used in different industrial installations in order to be able to hold a web securely on a transport path. This applies in particular to paper and board machines, where the web is transferred from one machine section to another machine section, for example from the wet section to the drying section or from the drying section to the finishing section.

DE 100 09 188 A1 discloses the use of vacuum belt conveying devices in paper or board machines in order to make it easier to thread the paper or board web into a machine for the production or finishing or further processing of such a web. During the starting of a paper machine or when restarting after a web break, a narrow strip or threading strip is severed from the moving web. This strip is transferred with the aid of the vacuum belt conveying device, for example from the end of one machine section to the input region of a following machine section. For this purpose, the conveying device comprises an air-permeable, endless conveyor belt, which runs over two rollers and over a suction box or vacuum box. Consequently, the threading strip is attracted to the conveyor belt by suction and transported. In order to produce a vacuum or a negative pressure within the suction box, a vacuum blower is provided. The vacuum blower comprises an impeller which has an outlet duct. The impeller is driven by a suitable motor. The suction box has one or more suction openings, via which the vacuum blower produces negative pressure in the interior of the suction box. The complicated and large-format construction is disadvantageous, additionally requires maintenance and is expensive to produce and to operate. Sealing the suction box is additionally difficult.

DE 35 24 006 A1 discloses a device for the transport and for the guidance of the web end threading strip into a paper machine, which comprises a transport belt arranged around two or more deflection rolls, which is air-permeable and within whose loop devices are fitted with which a vacuum effect is achieved on the one run of the transport belt with which the end threading strip is transported, by which means the end threading strip is attached to the aforementioned run and held firmly thereon. The vacuum is produced by air blowing devices which are fitted within the loop and comprise guide plates, which extend substantially parallel to the plane of the transport belt and on which a dynamic vacuum effect can be produced by air blowing means, with which the end threading strip is attached to the transport belt. The disadvantage is that, in order to blow on the guide plates, a rather large quantity of air is needed, which has to be led away and leads to undesired blown streams in the region around the device.

DE 299 24 658 U1 discloses a device for conveying and guiding a threading strip of a web in a paper machine of the aforementioned type, in which the device for producing a vacuum effect has curved air flow guiding surfaces along the transport belt which, in conjunction with foil heads, produce a vacuum. By adjusting the angle of the air flow guiding surfaces, the level of the vacuum can be regulated. Positive pressure regions which arise upstream of the foil heads are disadvantageous.

DE 200 01 082 U1 discloses a blower box. The walls of the blower box are double-layered. Between the layers of each wall a region is thus produced in which a pressure level that is lower than the pressure level of the surrounding air can be established in a targeted manner. Because of this, the air can flow out of the surroundings into the regions between the layers, so that the desired pressure level in the space is no longer affected detrimentally to a relevant extent. Consequently, an edge seal is generally created for spaces in which a lower pressure is to prevail than in the surroundings. Provision is made here for air injectors to be incorporated in the regions between the layers of the walls, the outlet openings of the said air injectors facing away from the gaps at the edge.

The object of the invention is, therefore, to provide a vacuum belt conveying device for guiding a moving web which is constructionally simple and takes up little space.

This object is achieved by the features of Claim 1.

In this way, a vacuum belt conveying device for guiding a moving web, in particular a web threading strip, is provided, whose device for applying a vacuum, in addition to a low overall height, has a form matched to the intended use, namely a rectangular form. In this case, the suction output is high and can be adjusted in the longitudinal and transverse direction. Drops in pressure between individual suction centres are minimized, so that a substantially uniform vacuum can be set over the width and/or the length of the transport belt in order to hold a web.

A nozzle row arrangement of the at least one long-gap ejector preferably extends transversely with respect to the belt running direction and produces an air stream at right angles to the belt. The air stream can than also simply be led away downwards, hindrances arising from undesired air streams in the region of the device being minimized.

A gap space of the at least one long-gap ejector preferably has a portion having a narrow cross section in order to achieve a high efficiency. If a lower efficiency is adequate, the gap space can also be formed without a cross-sectional narrowing.

The at least one long-gap ejector can also operate in conjunction with a suction chamber, for which purpose a dividing wall can be provided within the loop. The dividing wall is preferably arranged in the longitudinal direction of the transport belt and at a distance underneath the run which is provided to hold the web firmly. As a result, a suction chamber above the dividing wall is separated from an outward flow chamber below the dividing wall. The outward flow chamber is formed in a region above the other, return run and can be open to the outside or closed. If a plurality of long gap ejectors are arranged one after another in the longitudinal direction, it is also possible for transverse dividing walls to be provided, which subdivide the suction chamber and, if appropriate, the outward flow chamber into a plurality of chambers arranged one after another. In this way, selectable vacuum profiles can be set along the transport belt.

If a dividing wall is provided, a passage which is provided with an adjustable restrictor can be provided therein. Via the restrictor, a flow rate can be determined and therefore a maximum vacuum level can be set. The arrangement of the at least one long-gap ejector can be carried out such that it operates at right angles to the transport belt or at an angle to the transport belt.

The at least one long-gap ejector can have a gap space which has a cross-sectional narrowing on the outward flow side. As a result, the air flowing out can experience better distribution.

The at least one long-gap ejector can have a gap space whose flow path length can be selected. Consequently, the gap space can be used not only to take air in to produce a vacuum but, at the same time, can also be used to guide the air away in a specific manner from the region of the application of vacuum. In order to improve the vacuum attachment further, the air jet injector can be arranged in a convergent inlet region of the at least one long-gap ejector.

The alignment of the inlet region of the long-gap ejector or ejectors in relation to the running direction of the transport belt can be selected. The inlet region can be arranged transversely or obliquely with respect to the running direction or in the running direction; in the case of a plurality of long-gap ejectors, these can be arranged at a distance or immediately adjacent to one another in order to form selectable vacuum areas. In particular when a plurality of long-gap ejectors in the running direction form a vacuum strip in the running direction, only one row of long-gap ejectors, for example one central strip, can be provided or a plurality of rows of long-gap ejectors can be arranged in parallel with and at a distance from one another, for example two edge strips.

Further refinements of the invention can be gathered from the following description and the subclaims.

Figure 2:
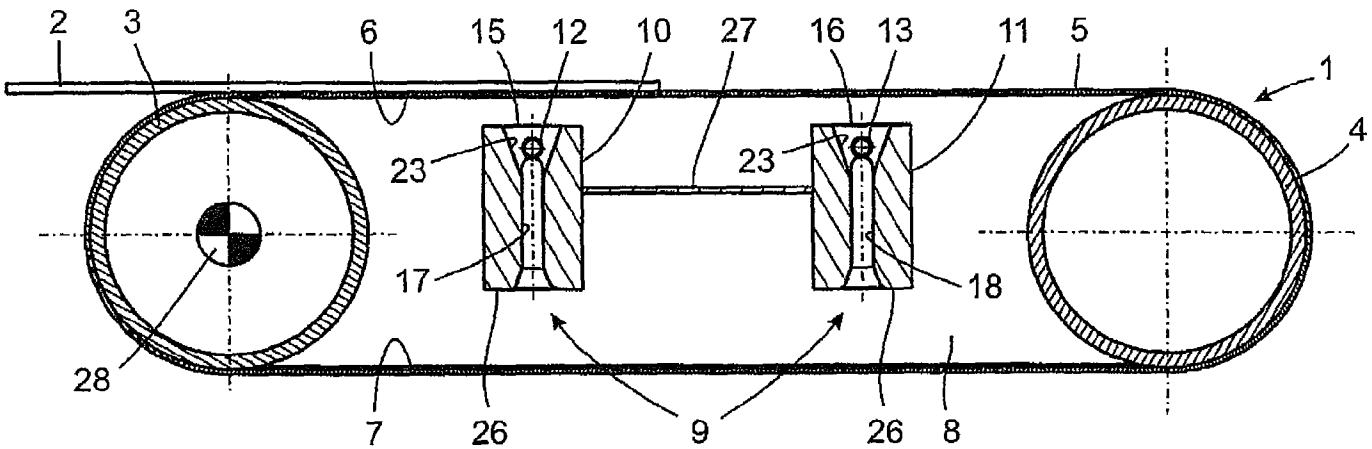
Figure 4A:
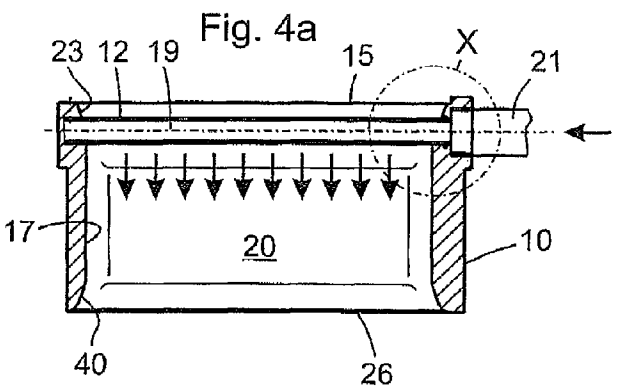
Figure 4B:
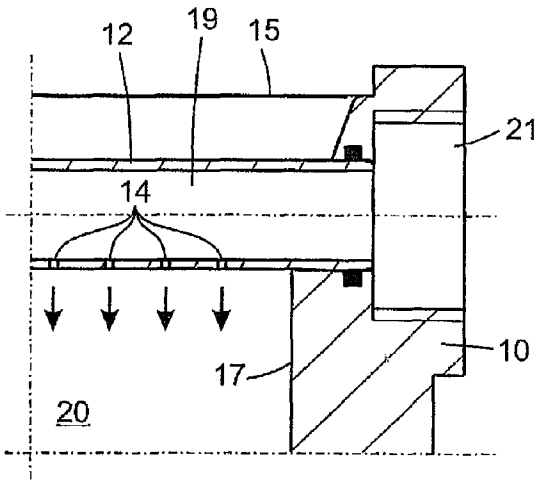
Figure 3:
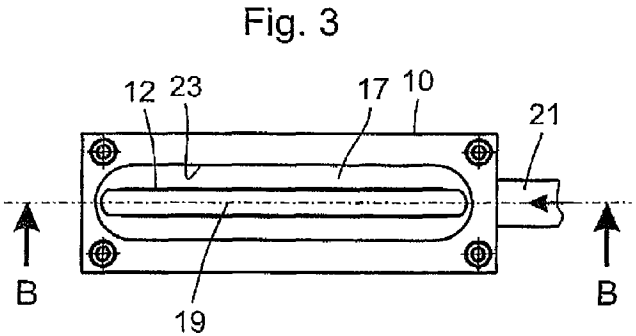
Figure 5:
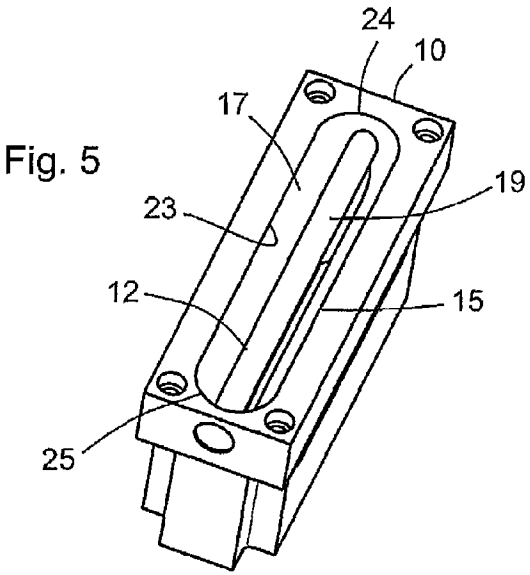
Figure 6:
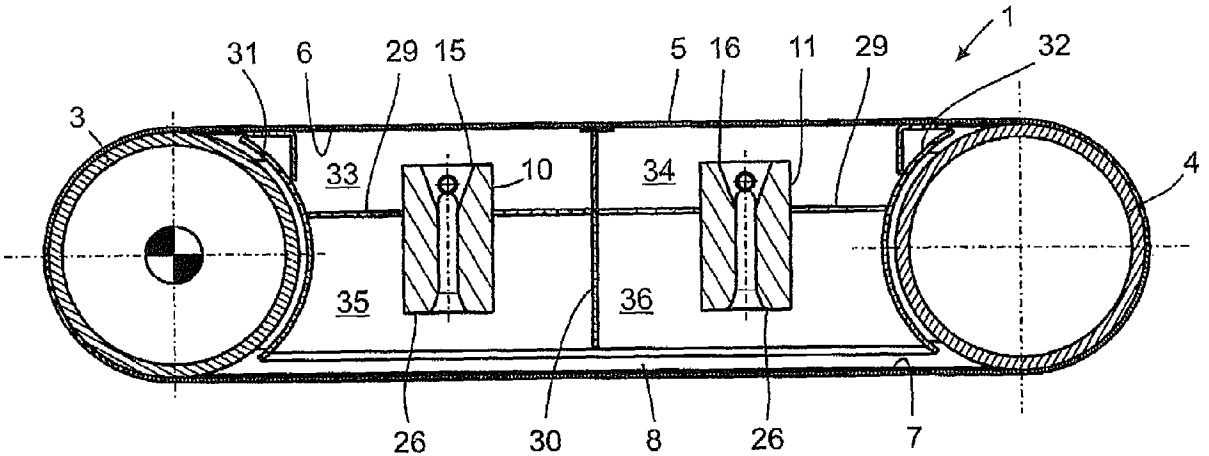
Figure 7:
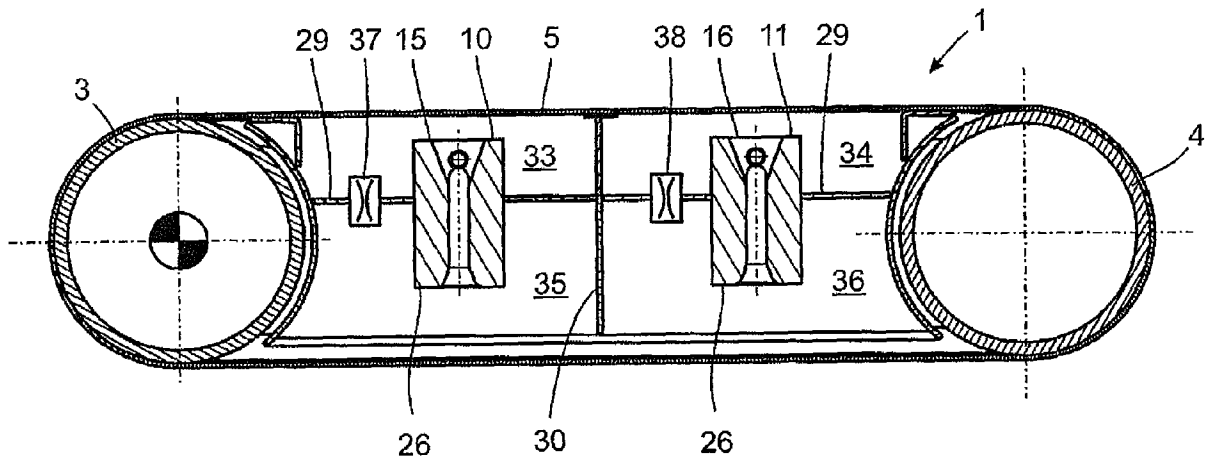
Figure 8:
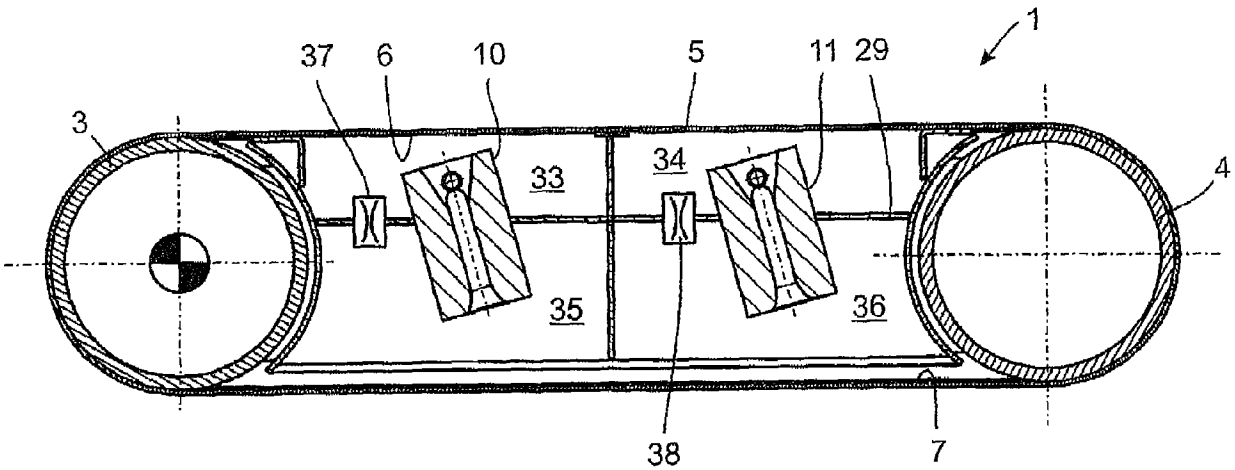
Figure 9:
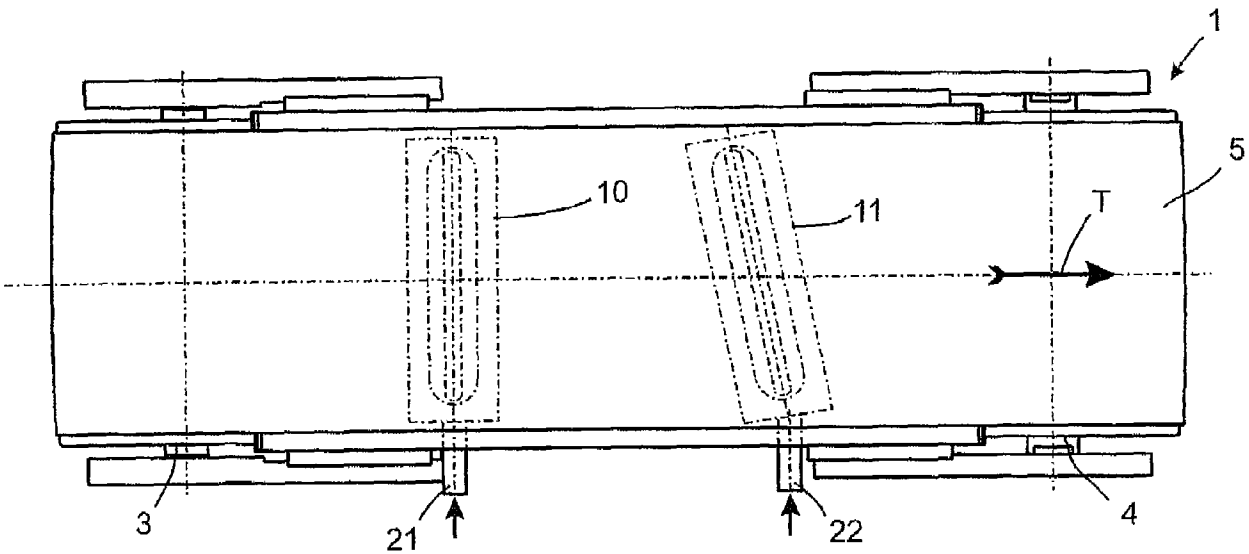
Figure 10:
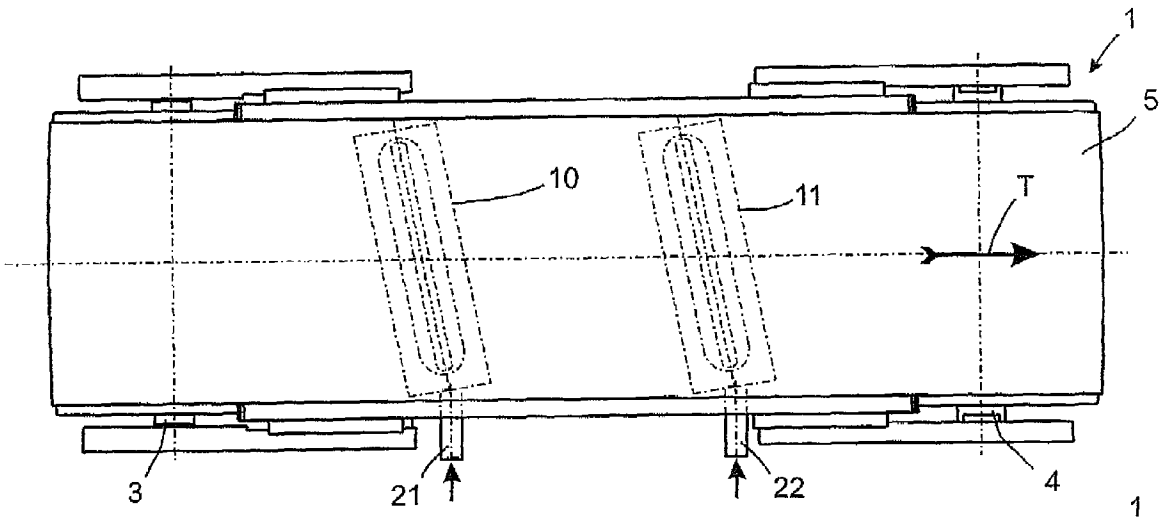
Figure 11:
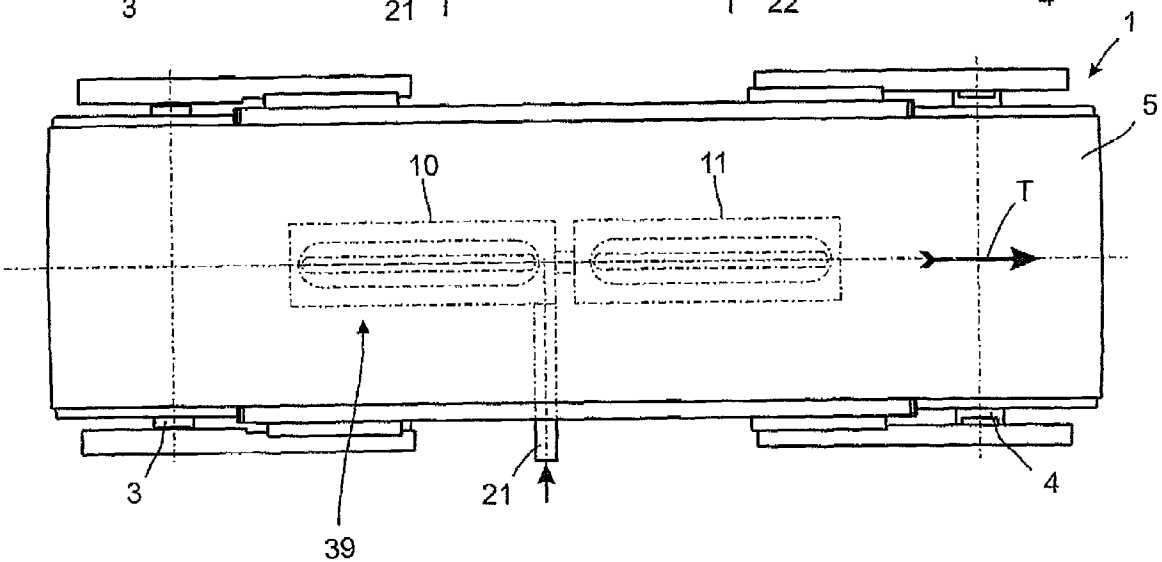
Figure 12A:
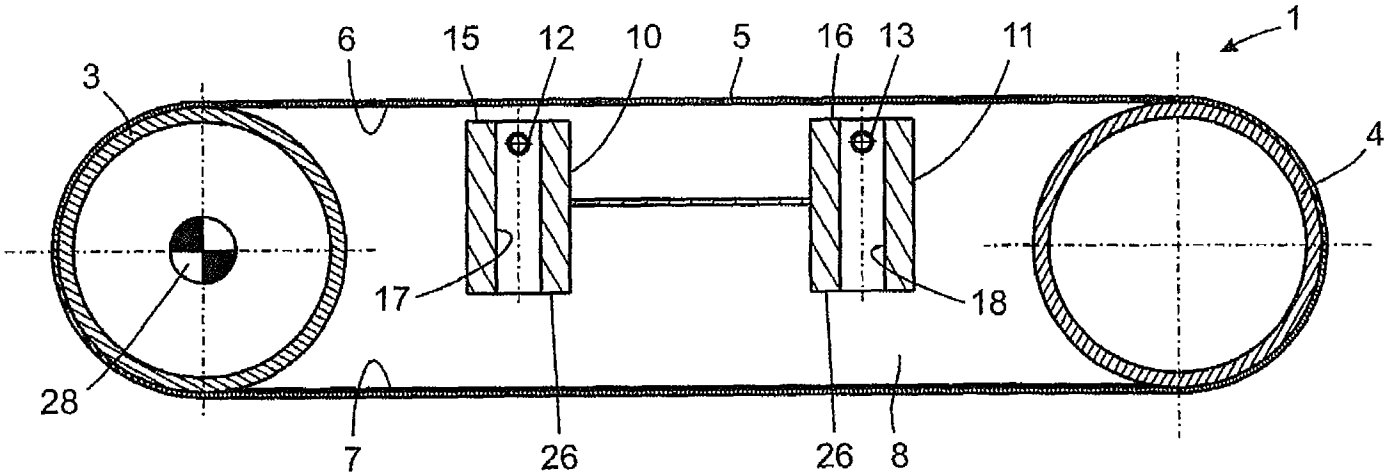
Figure 12B:
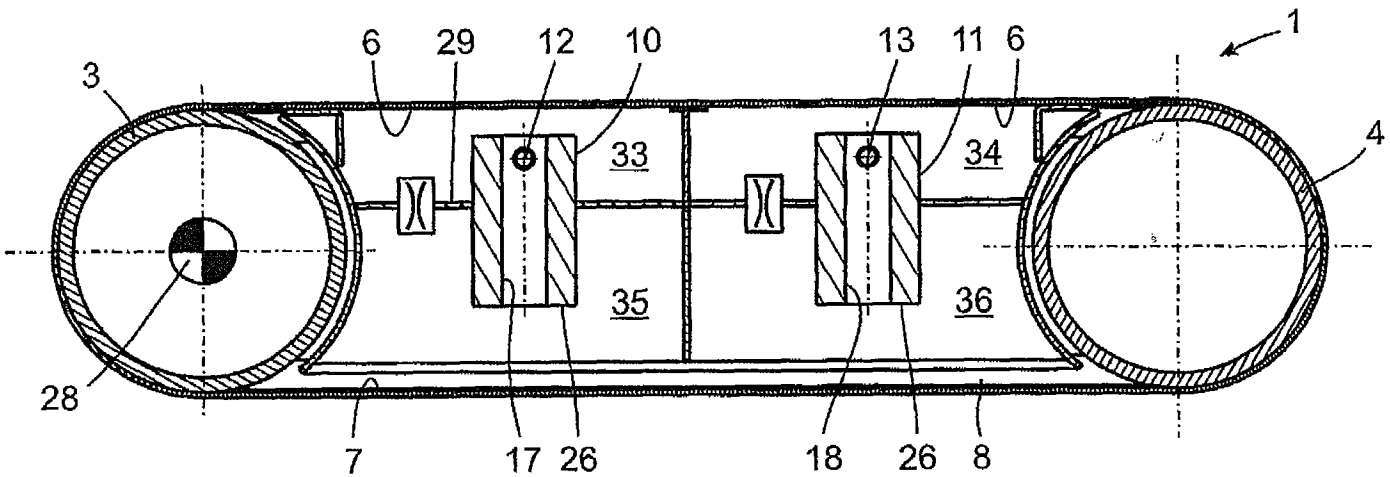

The invention will be explained in more detail below by using the exemplary embodiments illustrated in the appended drawings, in which:

FIG. 1 shows, schematically, a plan view of a vacuum belt conveying device,

FIG. 2 shows a section A-A according to FIG. 1 for a vacuum belt conveying device according to a first exemplary embodiment, FIG. 3 shows, schematically, a plan view of a long-gap ejector of the vacuum belt conveying device according to FIG. 2, FIG. 4*a* shows a section B-B of the long-gap ejector according to FIG. 3, FIG. 4*b* shows the region X from FIG. 4*a* enlarged, FIG. 5 shows a perspective view of the long-gap ejector according to FIG. 3, FIG. 6 shows a section A-A according to FIG. 1 for a vacuum belt conveying device according to a second exemplary embodiment, FIG. 7 shows a section A-A according to FIG. 1 for a vacuum belt conveying device according to a third exemplary embodiment, FIG. 8 shows a section A-A according to FIG. 1 for a vacuum belt conveying device according to a fourth exemplary embodiment, FIG. 9 shows, schematically, a plan view of a vacuum belt conveying device according to a fifth exemplary embodiment, FIG. 10 shows, schematically, a plan view of a vacuum belt conveying device according to a sixth exemplary embodiment, FIG. 11 shows, schematically, a plan view of a vacuum belt conveying device according to a seventh exemplary embodiment, FIGS. 12*a* and 12*b* each show a section A-A according to FIG. 1 for a vacuum belt conveying device according to an eighth and a ninth exemplary embodiment.

FIG. 1 shows a vacuum belt conveying device 1 for guiding a moving web 2, in particular a web threading strip of a paper or board web. The vacuum belt conveying device 1 comprises deflection rolls 3 and 4, between which a transport belt 5 is arranged. The transport belt 5 is guided endlessly in a loop 8 having an upper run 6 and a lower run 7, as shown, for example, in FIG. 1. The transport belt 5 is air-permeable and, to this end, comprises a cloth with adequate permeability or a material web with a perforated structure.

Arranged within the loop 8 is a device 9 for applying a vacuum to the inner side of one of the runs of the transport belt, the upper run 6 here, in order to hold the web 2 firmly on the transport belt 5. The device 9 for applying a vacuum is formed by means of at least one long-gap ejector 10, 11, which in each case has an air jet injector 12, 13 having a large number of air outlet nozzles 14 along the inlet side 15, 16 of the long gap 17, 18 and, on the inlet side, is positioned at a distance underneath the inner side of the run 6 provided for holding the web firmly. Via air feed lines 21, 22 connected laterally to the transport belt 5, the air jet injector 12, 13 of the at least one long-gap ejector 10, 11 is fed from an air source, not illustrated, in order to be able to inject air into the associated long gap 17, 18. The air fed in flows at high velocity through the air outlet nozzles 14, by which means air which is located in the surroundings of the top of the at least one long-gap ejector 10, 11 is taken in on the inlet side 15. In this way, a vacuum can be applied to the inner side of the run 6 via one or more air nozzles being fitted underneath the belt 5. The pressure of the air supplied is adjustable, which means that an influence can be exerted on the suction performance. If a plurality of long-gap ejectors 10, 11 are arranged one after another in the running direction, these can be given the same or a different air supply in order as a result to configure individually adjustable suction output profiles in the transport direction T.

The construction of the at least one long-gap ejector 10, 11 is illustrated in detail in FIGS. 3 to 5 for one long-gap ejector 10. The following explanations apply in the corresponding way to all the other long-gap ejectors. Accordingly, the long-gap ejector 10 has a substantially rectangular form and has an air jet injector 12. The air jet injector 12 is formed by a nozzle stock 19, which is arranged in the gap longitudinal direction and produces an air stream in the gap space 20 of the long gap 17. The nozzle stock 19 is preferably arranged to be countersunk with respect to the inlet side 15, which means that the air taken in on the inlet side is deflected into the gap space 20. The air jet injector 12 is preferably seated in a convergent inlet region 23 of the long-gap ejector 10, the short side edges 24, 25 of the long gap 17 preferably being rounded.

The long gap 17 of the long-gap ejector 10 can delimit the gap space 20 with parallel surfaces from the inlet side 15 up to an outlet side 26, that is to say extend without a narrowed cross section (cf. FIGS. 12*a*, 12*b*). For a high efficiency, the gap space 20 should preferably be formed with a narrowed cross section. The inlet region 23 with convergent side surfaces then extends until under the air jet injector 12. The narrowing in the cross section of the long gap 17 promotes the formation of a closed flow and therefore advantageous sealing of the air jet injector 12. The suction performance of a long-gap ejector 10, 11 on the inlet side 15 can be controlled via the air stream fed in and by the shape of the long gap 17 between inlet side 15 and outlet side 26. The length of the long gap 17 in the flow direction can be selected and opens up advantageous dissipation of the air.

On the outlet side 26, the long gap 17 is preferably formed with a widened cross-sectional portion 40, which improves the outward flow behaviour of the long-gap ejector 10 in relation to a wide air outlet distribution. Even in the case of a narrowed cross section of the long gap on the inlet and/or outlet side, the long gap 17 preferably has a portion with parallel side surfaces, which can make up about 50 to 80% of the total length of the long gap 17 in the flow direction between inlet side 15 and outlet side 26. To this extent, the long gap 17 forms a guide duct for the air stream with a selectable flow path length.

In the first exemplary embodiment of a vacuum belt conveying device, illustrated in FIG. 2, the device 9 for applying the vacuum comprises two long-gap ejectors 10, 11, which are arranged one after the other at a distance in the transport direction T. The number of long-gap ejectors 10, 11 arranged beside one another can be selected. The distance from the inner side of the run 6 can likewise be selected and depends on the suction performance. A minimum distance ensures that although the suction region is local it is sufficiently flat. The extent of the long gap 17 in the gap longitudinal direction can be selected as a function of a width of the transport belt 5 in order that attraction by suction takes place over the entire width of the transport belt 5. In the transport direction T, the long-gap ejector or ejectors 10, 11 can be arranged at selectable points, that is to say can be positioned where a suction attraction characteristic is desired. The respective air jet injector 12 having the associated nozzle stock 19 preferably extends transversely with respect to the belt running direction T for this purpose and produces an air stream at right angles to the belt 5. Here, the long-gap ejectors 10, 11 are arranged to operate at right angles to the transport belt 5.

For positioning the at least one long-gap ejector 10, 11, a holder 27 is provided which holds the long-gap ejectors 10, 11 in a fixed location in the loop 8. Furthermore, the long-gap ejectors 10,11 can be arranged in a self-supporting manner in the loop 8. The holder 27 can be formed by a frame belonging to the device 1, in which the deflection rolls 3, 4 are also mounted.

The transport belt 5 is moved in the transport direction T by at least one driven deflection roll 3, 4. According to FIG. 2, a drive motor 28 is provided for the deflection roll 3 for this purpose. In order to support the transport belt 5 on the loop between the deflection rolls 3, 4, supporting grids, not illustrated, can be provided.

According to a second exemplary embodiment of the vacuum belt conveying device, illustrated in FIG. 6, a dividing wall 29 is arranged within the loop 8. The dividing wall 29 divides a suction chamber 33, 34, in which the inlet side 15 of the at least one long-gap ejector 10, 11 with its respective inlet is arranged, from an outward flow chamber 35, 36, in which the outlet side 26 of the at least one long-gap ejector 10, 11 with its respective outlet is arranged. For this purpose, the dividing wall 29 preferably extends substantially parallel to the transport belt 5. The suction chamber 33, 34 preferably forms an upper chamber and the outward flow chamber 35, 36 forms a lower chamber, which is delimited at the sides with respect to the deflection rolls 3, 4 by covering plates 31, 32.

The suction chamber 33, 34 is delimited at the top by the run 6 of the air-permeable transport belt 5. Alternatively, the delimitation at the top can be provided by a perforated plate, on which the run 6 runs in a guided manner. The distribution and also the opening widths of the holes permit an influence to be exerted on the vacuum characteristics on the inner side of the run 6. The outward flow chamber 35, 36 is delimited at the bottom by the return run 7. If a plurality of long-gap ejectors 10, 11 are arranged, for example two, as illustrated in FIG. 6, the long-gap ejectors 10, 11 are assigned a suction chamber 33, 34 and an outward flow chamber 35, 36. By means of a transverse dividing wall 30, the subdivision of the suction chambers 33, 34 and of the outward flow chambers 35, 36 is possible. The at least one long-gap ejector 10, 11 takes air in from the respective suction chamber 33, 34, by which means a suction area corresponding to the suction chamber 33, 34 is applied to the inner side of the run 6. The distance of the inlet side 15 of the at least one long-gap ejector 10, 11 from the inner side of the run 6 can be chosen to be greater than in the case of the self-supporting long-gap ejectors 10, 11 according to FIG. 2. In order to take the air in from the respective suction chamber 33, 34 as uniformly as possible, the inlet side 15 is preferably positioned in a central region of the suction chamber 33, 34. Otherwise, the above explanations relating to the first exemplary embodiment apply in a corresponding way here.

According to a third exemplary embodiment of the vacuum belt conveying device 1, illustrated in FIG. 7, an adjustable restrictor 37, 38 is arranged in the dividing wall 29. Via the restrictors 37, 38, a flow rate between a suction chamber 33, 34 and an outward flow chamber 35, 36 can be determined, and therefore a maximum vacuum level can be set in a suction chamber 33, 34. A maximum vacuum in the suction chamber 33, 34 can be defined via such a bypass between suction chamber 33, 34 and outward flow chamber 35, 36. Beginning at a specific vacuum value, no further vacuum is built up, since the bypass flow via the restrictors 37, 38 then corresponds to the output suction flow. A specific pressure difference is set. The vacuum level is additionally adjustable. The risk that, in particular, relatively wet paper or board webs on the transport belt 5 will be damaged by excessively intense suction attraction therefore does not exist. Each suction chamber 33, 34 with associated outward flow chamber 35, 36 is preferably assigned a restrictor 37, 38. In addition, the drive power of the motor 28 can be kept low by limiting the vacuum level. Otherwise, the above explanations relating to the first and second exemplary embodiments apply in a corresponding way here.

The fourth embodiment of the vacuum belt conveying device, illustrated in FIG. 8, differs from the third embodiment, illustrated in FIG. 7, in that the at least one long-gap ejector 10, 11 is not arranged to operate at right angles to the transport belt 5 but is arranged to operate at an angle to the transport belt. The long-gap ejectors 10, 11 are inclined or tilted with respect to the transport plane of the transport belt 5. The suction attraction can be built up so as to lead or lag the outward flow with respect to the transport direction T. Otherwise, the above explanations relating to the other exemplary embodiments apply in a corresponding way here.

The exemplary embodiments of the vacuum belt conveying device 1 illustrated in FIGS. 9 to 11 relate to different arrangements of the at least two long-gap ejectors 10, 11 in relation to the running direction T. In the fifth exemplary embodiment, according to FIG. 9, a first long-gap ejector 10 is positioned transversely with respect to the running direction T, while a second long-gap ejector 11 positioned at a distance is arranged obliquely with respect to the transport direction T. The order can also be reversed. In the case of the sixth exemplary embodiment according to FIG. 10, both long-gap ejectors 10, 11 are arranged obliquely with respect to the transport direction T. The angle with respect to the transport direction T can be selected on the basis of the choice of the vacuum profile which can be produced as a result. In the seventh exemplary embodiment, according to FIG. 11, the long-gap ejectors 10, 11 are arranged one after another in a row, forming a suction strip 39. As illustrated in FIG. 11, this suction strip 39 can form a central strip. Alternatively, an edge strip or edge strips on both sides can be provided. Otherwise, the above explanations relating to exemplary embodiments one to four apply in a corresponding way here.

FIGS. 12*a* and 12*b* show an eighth and ninth exemplary embodiment of the vacuum belt conveying device 1, which differ from the above embodiments in that the long gap 17, 18 does not have a cross-sectional narrowing, i.e. has parallel side walls. The efficiency is lower, so that the long-gap ejector 10, 11 is preferably arranged closer to the inside of the run 6 of the transport belt 5. Otherwise, the explanations relating to the first exemplary embodiment according to FIG. 2 apply in a corresponding way to the eighth exemplary embodiment according to FIG. 12*a*. The explanations relating to the third and fourth exemplary embodiment according to FIGS. 7 and 8 apply in a corresponding way to the ninth exemplary embodiment according to FIG. 12*b*.

According to a further exemplary embodiment, not illustrated, the vacuum belt conveying device 1 can also operate rotated through 180° , that is to say the vacuum is applied to the return run, with corresponding rotation of the long-gap ejectors and reversal of the transport direction.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

The invention claimed is:

1. Vacuum belt conveying device for guiding a moving web, in particular a web threading strip of a paper or board web, having an air-permeable transport belt guided endlessly in a loop with an upper run and a lower run, and a device arranged within the loop for applying a vacuum to the inner side of one of the runs of the transport belt in order to hold the web firmly on the transport belt, wherein the device for applying a vacuum is formed by means of at least one long-gap ejector, which in each case has an air jet injector having a large number of air outlet nozzles along the inlet side of the long gap and, on the inlet side, is positioned at a distance under the inner side of the run which is provided to hold the web firmly; and wherein within the loop there is arranged a dividing wall, which divides a suction chamber, in which the inlet side of the at least one long-gap ejector is arranged, from an outward flow chamber, in which an outlet side of the at least one long-gap ejector is arranged.

2. Vacuum belt conveying device according to claim 1, wherein the at least one long-gap ejector produces a flow in a gap space via a nozzle stock arranged in the gap longitudinal direction.

3. Vacuum belt conveying device according to claim 2, wherein the gap space is formed with a narrowed cross section.

4. Vacuum belt conveying device according to claim 1, wherein the suction chamber and outward flow chamber have transverse walls between adjacent long-gap ejectors.

5. Vacuum belt conveying device according to claim 1, wherein the suction chamber can be connected to the outward flow chamber via at least one restrictor in order to limit a vacuum.

6. Vacuum belt conveying device according to claim 5 wherein the at least one restrictor is arranged in a dividing wall between suction chamber and outward flow chamber in order to control a flow rate.

7. Vacuum belt conveying device according to claim 1, wherein the at least one long-gap ejector is arranged to operate at right angles to the transport belt.

8. Vacuum belt conveying device according to claim 1, wherein the at least one long-gap ejector is arranged to operate at an angle to the transport belt.

9. Vacuum belt conveying device according to claim 1, wherein the at least one long-gap ejector in each case has a gap space which has an outlet portion with a widened cross section.

10. Vacuum belt conveying device according to claim 1, wherein the at least one long-gap ejector in each case has a gap space with a selectable flow path length.

11. Vacuum belt conveying device according to claim 8, wherein the flow path length of the gap space having a narrowed cross section is 50 to 80% of the total flow path length of the gap space.

12. Vacuum belt conveying device according to claim 1, wherein the air jet injector is arranged in a converging inlet region of a long-gap ejector.

13. Vacuum belt conveying device according to claim 1, wherein the at least one long-gap ejector is arranged transversely with respect to the running direction of the transport belt.

14. Vacuum belt conveying device according to claim 1, wherein the at least one long-gap ejector is arranged obliquely with respect to the running direction of the transport belt.

15. Vacuum belt conveying device according to claim 1, wherein a plurality of long-gap ejectors are arranged adjacent to one another in the running direction of the transport belt.

16. Vacuum belt conveying device according to claim 15, wherein, depending on the running length of the transport belt, at least two long-gap ejectors are arranged at a distance from each other in the running direction of the transport belt.

17. Vacuum belt conveying device according to claim 15, wherein the long-gap ejectors are arranged with the gap longitudinal direction in the running direction of the transport belt, forming at least one vacuum strip.

18. Vacuum belt conveying device according to claim 1, wherein the at least one long-gap ejector has an inlet region with rounded short side edges.

19. Vacuum belt conveying device according to claim 1, wherein the at least one air jet injector can be fed via feed lines arranged laterally on the transport belt.

20. Vacuum belt conveying device according to claim 1, wherein an outward flow chamber can be encapsulated for controllable dissipation of the air flowing out.

21. Vacuum belt conveying device according to claim 1, wherein air can be supplied to the at least one long-gap ejector via a feed line, and the pressure of the air can be adjusted.

22. Vacuum belt conveying device according to claim 21, wherein a plurality of long-gap ejectors are arranged adjacent to one another, and air can be supplied to the feed lines at a respectively adjustable pressure.

* * * * *